US009055857B2

(12) United States Patent
Hotz et al.

(10) Patent No.: US 9,055,857 B2
(45) Date of Patent: Jun. 16, 2015

(54) DOMESTIC APPLIANCE WITH A DOOR-WEIGHT COMPENSATING DEVICE

(75) Inventors: Dieter Hotz, Dischingen (DE); Cengiz Kücük, Syrgenstein (DE); Manfred Seeβle, Gerstetten (DE); Martin Stickel, Giengen/Brenz (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 12/739,960

(22) PCT Filed: Oct. 16, 2008

(86) PCT No.: PCT/EP2008/063981

§ 371 (c)(1),
(2), (4) Date: Apr. 27, 2010

(87) PCT Pub. No.: WO2009/059879

PCT Pub. Date: May 14, 2009

(65) Prior Publication Data

US 2011/0163643 A1 Jul. 7, 2011

(30) Foreign Application Priority Data

Nov. 7, 2007 (DE) ..... 10 2007 053 093

(51) Int. Cl.
*A47L 15/42* (2006.01)
*E05F 1/10* (2006.01)

(52) U.S. Cl.
CPC ..... *A47L 15/4261* (2013.01); *Y10T 16/5389* (2015.01); *E05F 1/1075* (2013.01); *E05Y 2201/654* (2013.01); *E05Y 2201/66* (2013.01);

(Continued)

(58) Field of Classification Search
CPC ..... A47L 15/4261; E05F 1/1075; E05Y 2900/304; E05Y 2900/20; E05Y 2201/66; E05Y 2201/652; E05Y 2201/654; F24C 15/023; Y10T 16/5389
USPC ..... 312/319.1, 319.2, 319.4, 327, 328, 228; 49/386, 387; 16/78, 81, 72, 286; 126/191, 194, 197
See application file for complete search history.

(56) References Cited

U.S. PATENT DOCUMENTS 2,921,575 A * 1/1960 Fry ..... 126/191
3,046,974 A * 7/1962 Kimberley ..... 126/191
3,049,114 A * 8/1962 Carnahan et al. ..... 126/191

(Continued)

FOREIGN PATENT DOCUMENTS

DE 1753071 7/1971
DE 3911555 A1 10/1990

(Continued)

*Primary Examiner* — Daniel J Troy
*Assistant Examiner* — Hiwot Tefera
(74) *Attorney, Agent, or Firm* — James E. Howard; Andre Pallapies

(57) ABSTRACT

An appliance including a treatment container having a container door pivotable about a pivot axis, and a door-weight compensating device for at least partially compensating a weight of the container door. The door-weight compensating device may include a spring which is connected by a tension transmitter in a spring force transmitting manner to the container door. In an exemplary embodiment, the container door includes a deflector pivotally disposed about the pivot axis, the deflector having at least two sliding surfaces for deflecting the tension transmitter.

16 Claims, 4 Drawing Sheets

(52) U.S. Cl.
CPC ..... *E05Y 2900/20* (2013.01); *E05Y 2900/304* (2013.01)

(56) References Cited

U.S. PATENT DOCUMENTS

| | | | | |
|---|---|---|---|---|
| 3,049,115 | A * | 8/1962 | Carnahan et al. | 126/191 |
| 4,755,647 | A * | 7/1988 | Nishikawa et al. | 219/724 |
| 4,915,460 | A * | 4/1990 | Nook et al. | 312/138.1 |
| 5,341,542 | A * | 8/1994 | Hannan et al. | 16/289 |
| 5,386,884 | A * | 2/1995 | Chisholm | 185/39 |
| 5,388,901 | A * | 2/1995 | Asano | 312/222 |
| 5,823,643 | A * | 10/1998 | Feldpausch et al. | 312/221 |
| 5,980,006 | A | 11/1999 | Wihelmstaetter et al. | |
| 5,988,933 | A | 11/1999 | Wihelmstaetter et al. | |
| 6,467,128 | B1 * | 10/2002 | Damani | 16/197 |
| 6,505,381 | B1 * | 1/2003 | Thomson et al. | 16/302 |
| 6,557,958 | B1 * | 5/2003 | Motta et al. | 312/319.2 |
| 6,619,706 | B2 * | 9/2003 | Mackie | 292/194 |
| 7,862,132 | B2 * | 1/2011 | Tynes et al. | 312/328 |
| 8,393,691 | B2 * | 3/2013 | Diebold et al. | 312/228 |
| 8,931,859 | B2 * | 1/2015 | Kozinski et al. | 312/319.2 |
| 2001/0020811 | A1 * | 9/2001 | Kawanabe | 312/319.2 |
| 2002/0113532 | A1 * | 8/2002 | Hornberger et al. | 312/319.2 |
| 2003/0117047 | A1 * | 6/2003 | Heidmann et al. | 312/323 |
| 2004/0113531 | A1 * | 6/2004 | Raches | 312/319.2 |
| 2007/0103041 | A1 * | 5/2007 | Kropf et al. | 312/333 |
| 2007/0283524 | A1 * | 12/2007 | Gordon | 16/78 |
| 2008/0122331 | A1 * | 5/2008 | Haeberle | 312/319.1 |
| 2008/0271727 | A1 * | 11/2008 | Collene et al. | 126/197 |
| 2008/0272678 | A1 * | 11/2008 | Tynes et al. | 312/319.4 |
| 2008/0276925 | A1 * | 11/2008 | Griswold et al. | 126/19 R |
| 2010/0045152 | A1 * | 2/2010 | Bond et al. | 312/319.1 |
| 2010/0127606 | A1 * | 5/2010 | Collene et al. | 312/327 |

FOREIGN PATENT DOCUMENTS

| | | | |
|---|---|---|---|
| DE | 9205222 | U1 | 9/1993 |
| DE | 29615527 | U1 | 2/1998 |
| DE | 19958817 | A1 | 6/2001 |
| WO | 2006137039 | A2 | 12/2006 |

* cited by examiner

DOMESTIC APPLIANCE WITH A DOOR-WEIGHT COMPENSATING DEVICE

BACKGROUND OF THE INVENTION

Domestic appliances with a treatment container, such as dishwashers, washing machines and ovens, are nowadays commercially available in a wide variety of forms. In a typical design, a container door which is pivotable about a horizontal pivot axis is provided which can be moved to a closed position to seal the treatment container and to an open position for filling or emptying the treatment container.

To make the domestic appliance as user-friendly as possible, door-weight compensating devices are used by means of which the weight of the container door is at least partially compensated when it is opening and closed. For example, such door-weight compensating devices on the one hand restrain the door opening movement so that, when it is folded down, the container door does not fall unchecked into its open position under its own weight, and, on the other hand, assist the door closing movement so that the user does not have to overcome the full weight of the container door in order to swivel it to its closed position. Rather it often usually suffices for the user to initiate the closing movement, and the container door then closes automatically as a result of the door-weight compensating device.

A generic domestic appliance is described in the Applicant's published unexamined German patent application DE 196 11 051 A1. In the domestic appliance shown there, the treatment container door which is pivotable about a horizontal pivot axis is pivotally mounted on a hinge plate which is in turn fixed in a base support serving as a base for installing the domestic appliance. The door-weight compensating device, which is disposed on both sides of the domestic appliance, comprises a tension spring attached at one end to the base support, and a tension cable, one end of which is connected to the other end of the spring. The other end of the tension cable is suspended from a lever arm of a pivotable hinge lever to whose other lever arm the front door is attached. The hinge lever is pivotally mounted on the hinge plate. The tension cable thus connecting the tension spring to the hinge lever, i.e. the container door, is threaded through a deflector mounted on the base support to deflect the cable pulling direction. If the container door is folded down into its open position, the hinge lever is carried along and the tension spring is tensioned via the suspended tension cable so that the opening movement of the container door is braked. If the container door is folded up into its closed position, the tensioned spring is unloaded and assists the closing movement with its spring force.

In the door-weight compensating device shown in DE 196 11 051 A1, the deflector for the tension cable is pivotally mounted about a pivot axis on the hinge plate fitted in the base support. The disadvantage of this in manufacturing terms is that the deflector must first be pre-fitted to the hinge plate and only then can the hinge plate be fixed to the base support. In addition, the tension spring is accommodated in a spring channel formed inside the base support and only accessible from the bottom. For the manufacturing process, this means that when the hinge plate provided with the pre-fitted deflector has been fixed to the base support, the base support must first be rotated to enable the tension spring with the thereto attached tension cable to be inserted from below into the corresponding spring channel, which involves a considerable amount of time and effort for the fitter. On the other hand, the tension cable must subsequently be threaded into the already fitted deflector, which tends to prove difficult and relatively time consuming.

In the generic DE 196 11 051 A1, the attachment of the deflector to the hinge plate is not described in greater detail. This has hitherto been implemented by the Applicant in industrial-scale production in such a way that a pivot bolt with a lug projecting perpendicularly therefrom is provided for this purpose on the deflector. Said pivot bolt is inserted through a keyhole-shaped slot in the hinge plate and turned such that the lug engages behind the slot in the hinge plate, thereby ensuring that the deflector is secured in its axial position. For this reason, however, the deflector cannot be implemented as an identical part that can be used both on the right-hand side and on the left-hand side of the domestic appliance. In large-scale industrial production, this has the disadvantage that both a "left-hand" deflector and a "right-hand" deflector must be held available, which increases manufacturing and warehousing costs.

BRIEF SUMMARY OF THE INVENTION

Consequently, there exists a need for a generic domestic appliance which avoids the above mentioned disadvantages and can be produced in industrial scale in a technically simple and cost-effective manner.

The position information given in the description of the invention, such as front, back, top, bottom, horizontal and vertical, relates to a domestic appliance placed on a horizontal surface and serves merely to facilitate the presentation of the invention, without the invention being limited thereto.

The invention is based on a domestic appliance, in particular a dishwasher, at least having:

a. a treatment container with container door pivotable about a pivot axis and
b. a door-weight compensating device for at least partially compensating the weight of the container door by spring force of a spring means which is connected in a spring force transmitting manner by a tension transmitting means to the container door which has a deflector pivotally disposed about a pivot axis.

It is inventively provided that the deflector has at least two sliding surfaces for deflecting the tension transmitting means. For example, the deflector is pivotally mounted about a pivot axis in the recess and preferably secured against axial displacement by means of a locking element projecting into the recess. This design allows particularly simple fitting of the deflector which in particular enables the deflector to be preferably implemented in the form of a mirror-symmetrical identical part, thereby enabling deflector production and warehousing costs to be reduced.

It is preferably provided that the deflector is held by door weight forces in a position of engagement with the locking element, so that no additional components are necessary to ensure that the deflector is retained in its position after fitting of the door.

For this purpose, the locking element is disposed on a base support to which a treatment container of the domestic appliance is attached.

In another advantageous embodiment of the domestic appliance according to the invention, the deflector has two mirror-inverted sliding surfaces implemented in the form of circular segment sections for the tension transmitting means, which are disposed such that an approximately "S"-shaped sliding guide for the tension transmitting means is formed. Said sliding surfaces are implemented essentially, i.e. within manufacturing tolerances, in a mirror-symmetrical manner.

The domestic appliance has a treatment container which is fixed on a base support used as a base for installing the domestic appliance and which is accommodated in an appliance housing having at least two sidewalls disposed laterally with respect to the treatment container. The treatment container can be opened and closed via a container door pivotable about a horizontal pivot axis, in particular a front door that can be folded down in the forward direction, so as to provide access to the interior space enclosed by the treatment container.

The domestic appliance also incorporates the door-weight compensating device for at least partially compensating the weight of the door or more specifically the torque produced by the weight of the door when the door is opened and closed, said device having a spring means attached to the base support, a tension transmitting means connecting the spring means to the door, and a deflector for deflecting the pulling direction of the tension transmitting means.

It is essential here that the deflector and the spring means are accommodated in a lateral recess formed by the base support, said recess being open to the outside (i.e. to the exterior of the base support) or more precisely to the adjacent housing sidewall.

With the domestic appliance according to the invention, the deflector and the spring means can be fitted to the base support from the side. This means that, for the first time, the door-weight compensating device can be fitted in a simple, fast and reliable manner without having to rotate the base support. As the deflector is not mounted to the hinge plate, but directly to the base support, the tension transmitting means can also be advantageously threaded into the deflector even before the deflector is fitted to the base support, thereby further simplifying the fitting of the door-weight compensating device.

In an advantageous embodiment of the domestic appliance from a manufacturing point of view, the deflector is accommodated in a recess section extending vertically and the spring means in a recess section extending horizontally, it being particularly advantageous if the vertically extending recess section is disposed in the front area of the domestic appliance.

In the deflector for deflecting the pulling direction of the tension transmitting means, the door opening characteristic can be influenced in a targeted manner by selecting the sliding friction properties of the sliding surfaces used for guiding the tension transmitting means. In particular, it is possible for the sliding surfaces and the other components of the deflector to be made of mutually different materials in order thereby, on the one hand, to optimize the sliding friction properties of the sliding surfaces and, on the other hand, to optimize the stability of the deflector independently of one another. For example, the sliding surfaces can be made of plastic and the other components of the deflector of a metallic material (bi-component technology).

In the domestic appliance according to the invention, the tension transmitting means can be implemented, for example, in the form of a tension cable or tension belt and the spring means e.g. in the form of a coil spring.

The invention also relates to a domestic appliance door-weight compensating device as described above wherein the deflector for deflecting the pulling direction of the tension transmitting means and the spring means are accommodated in a lateral recess which is formed by the base support and open to the outside, and to a corresponding deflector for deflecting the pulling direction of the tension transmitting means.

BRIEF DESCRIPTION OF THE DRAWINGS

The invention will now be explained in greater detail with reference to an exemplary embodiment and the accompanying drawings in which.

DETAILED DESCRIPTION OF EXEMPLARY EMBODIMENTS OF THE PRESENT INVENTION

Figure 1:
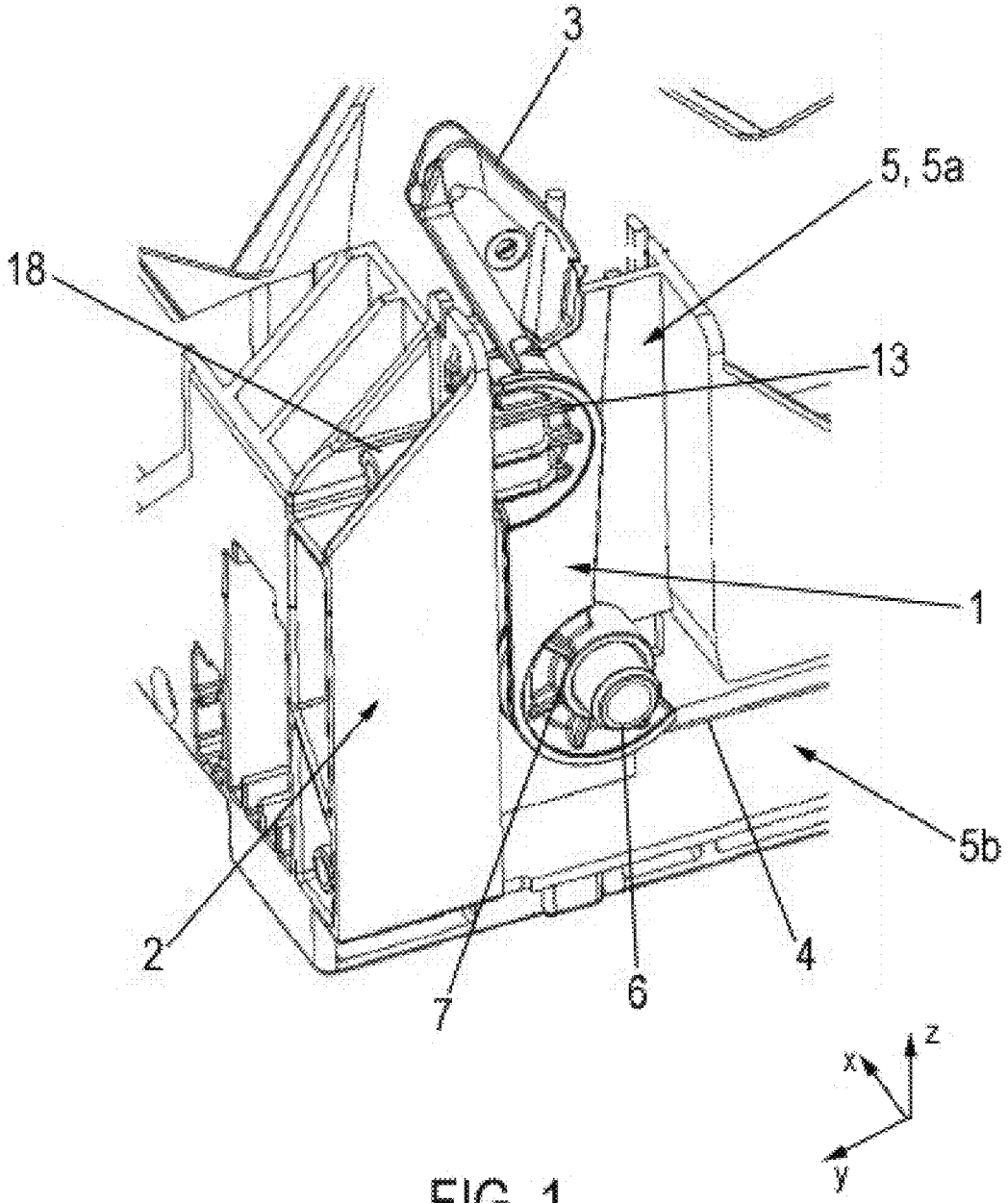
FIG. 1 shows a schematic perspective view of the arrangement of a deflector for the tension transmitting means of a door-weight compensating device of an exemplary embodiment of the domestic appliance according to the invention.

An exemplary embodiment of the inventive domestic appliance with a door-weight compensating device having a deflector for deflecting the pulling direction of the tension transmitting means will now be explained with reference to FIGS. 1 to 4.

For easier reference, an orthogonal x-y-z coordinate system is shown in which three mutually perpendicular coordinate axes x, y, z span the space. A horizontal surface which is used as the standing surface for the domestic appliance is given by the x-y plane spanned by the x- and y-axes. Even for components not shown in the Figures, said components' spatial arrangement within the x-y-z coordinate system is specified merely for the purpose of better understanding.

The door-weight compensating device illustrated in the Figures, comprising a deflector for deflecting the pulling direction of the tension transmitting means, is installed in a domestic appliance as described, for example, in generic published unexamined German patent application DE 196 11 051 A1 of the applicant.

Such a domestic appliance is provided with a treatment container open to the front (in the y-axis direction) which can be opened and closed via a front door (disposed in the x-z plane) which is pivotally mounted about a horizontal pivot axis (oriented parallel to the x-axis direction) in order to fill the treatment container with items to be treated or to empty it. In addition, the treatment container is fixed at the front in a base support ("floor assembly") serving as a base for installing the domestic appliance, via two hinge plates projecting downward (in the z-axis direction) from the treatment container which are e.g. screwed or welded to the side of the treatment container. At the back, the treatment container is fixed in the base support via two downward (in z-axis direction) projecting supports which are attached to the treatment container so that the treatment container is altogether placed on the base support via four legs and fixed there.

The front door for opening and closing the treatment container is attached to the lever arms of hinge levers which are hinged by means of swivel bearings to the two hinge plates fixed to the base support. For convenient handling of the domestic appliance, there is disposed on either side of the treatment container, arranged in a mirror-inverted manner, a door-weight compensating device which is capable of at least partially compensating the weight or more precisely the torque produced during opening and closing.

Each of the two door-weight compensating devices incorporates a tension spring attached at one end to the base support and connected by its other, free end to one end of a tension transmitting means implemented here as a tension cable, for example. Said tension cable is suspended by its other end from the pivotable hinge lever's lever arm not connected to the front door. The tension cable connecting the tension spring to the hinge lever is threaded through a deflector mounted on the base support to deflect the cable direction.

Figure 2:
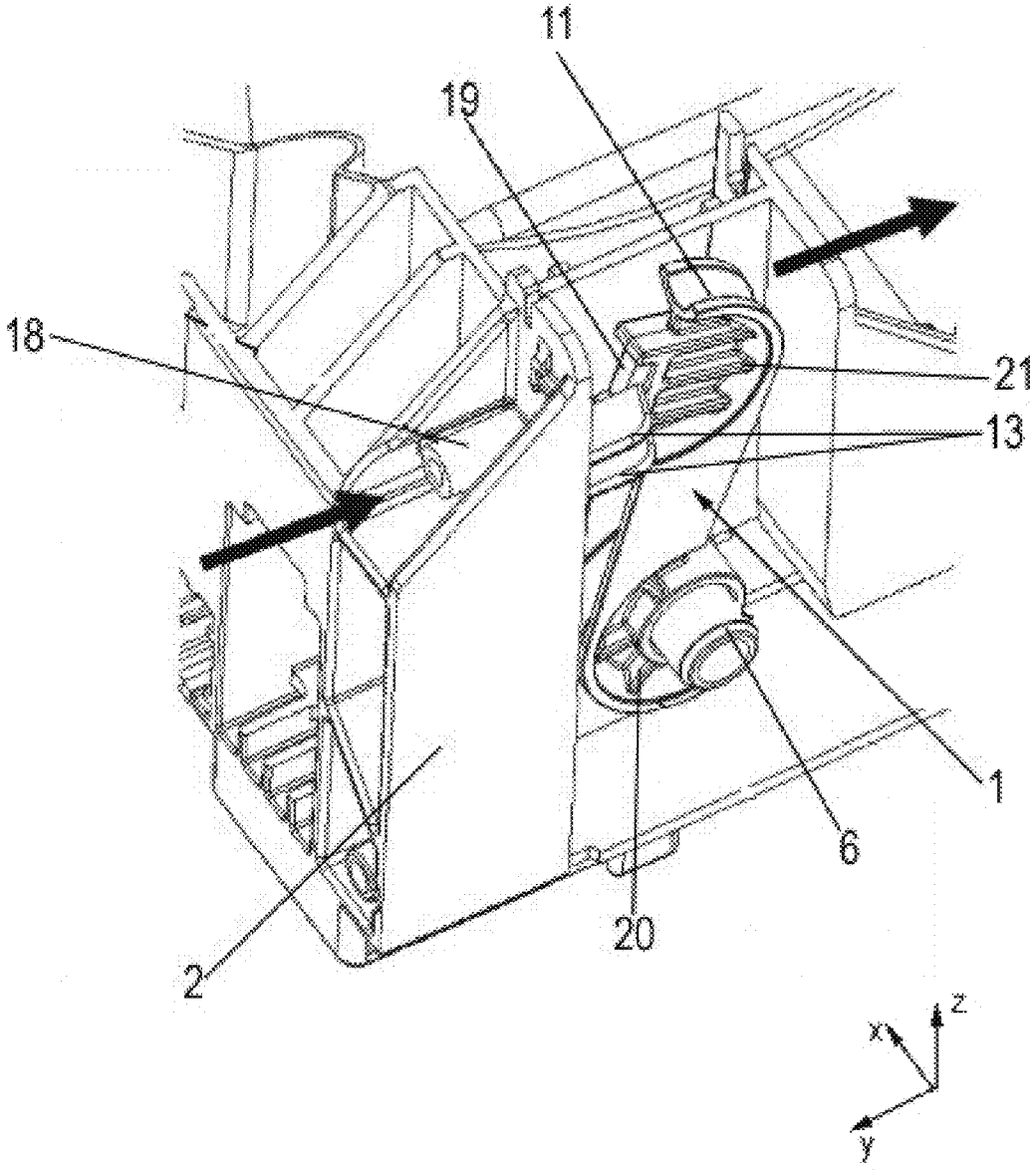
FIG. 2 shows a schematic perspective view of the arrangement of the deflector for the tension transmitting means of the door-weight compensating device of FIG. 1.
Figure 3:
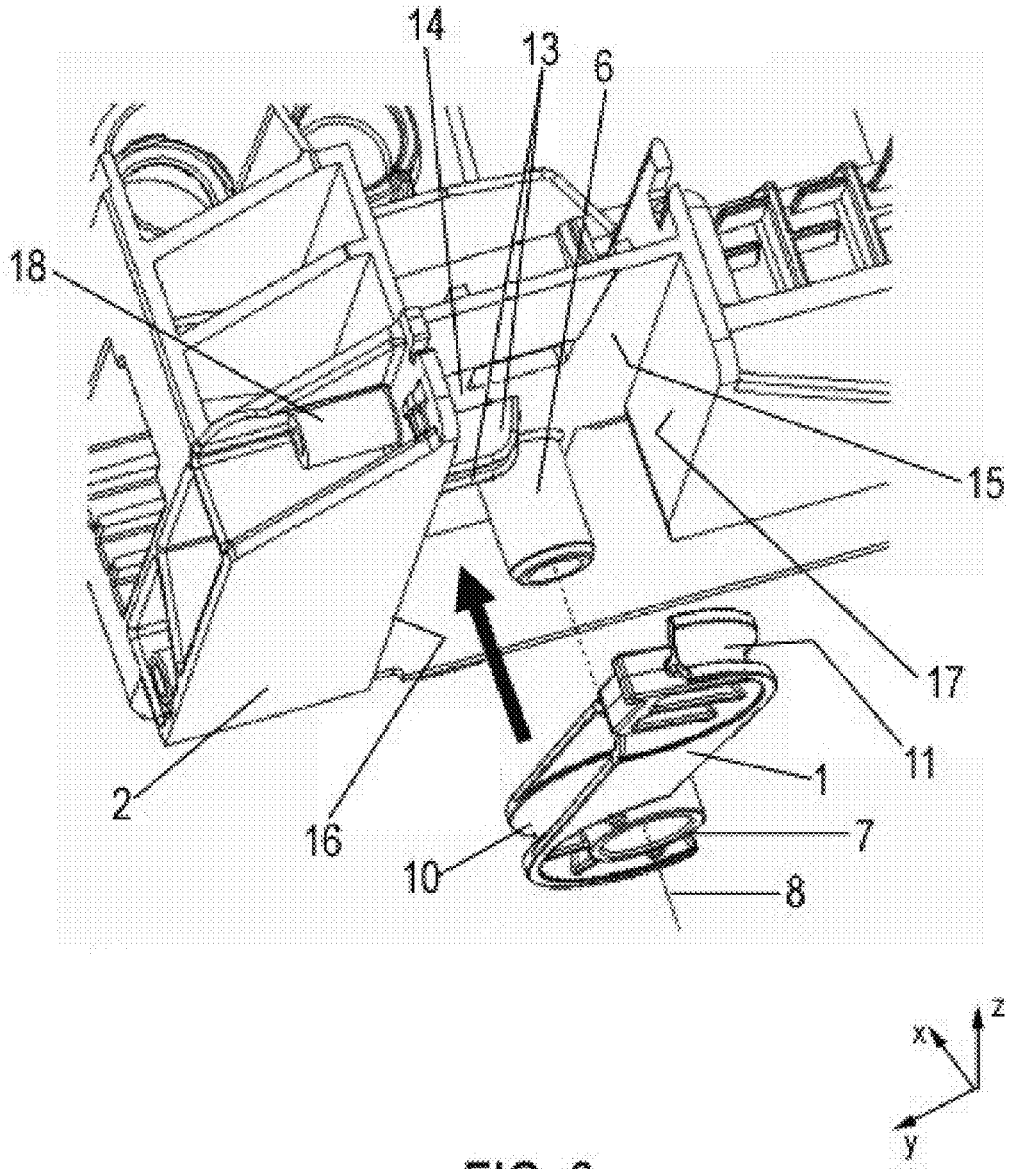
FIG. 3 is another schematic perspective view illustrating the fitting of the deflector for the tension transmitting means of the door-weight compensating device of FIG. 1.

FIGS. 1 to 3 each show a section of the base support (floor assembly) containing the left-hand front corner, altogether designated by the reference character 2, which base support, in a perspective view obliquely from above, rests on a horizontal surface (x-y plane) not further illustrated here. The base support 2 is, in top view, approximately rectangular, having a front edge and a back edge extending approximately parallel to the front door (in the x-axis direction), and a left-hand side edge and a right-hand side edge extending approximately at right angles to the front door (in the y-axis direction). In addition to its function for installing the domestic appliance and of fixing the treatment container, the base support 2 is also used to accommodate various components of the domestic appliance, such as a circulating pump and an electronic control device in the case of a dishwasher. In the completely assembled state, the base support 2 with the treatment container fixed in place is enclosed by an appliance housing comprising two sidewalls on either side of the treatment container and a rear wall at the back of the treatment container.

A deflector 1 for the pulling direction of the tension cable 4 of the door-weight compensating device is shown in the Figures. The deflector 1 is accommodated in a lateral recess 5 formed by the base support 2 and which is open to the outside (i.e. to the adjacent housing sidewall of the appliance housing). The recess 5 may also be described as an indentation of the lateral edges of the base support 2.

The recess 5 is composed of two recess sections, namely a vertical recess section 5*a* extending essentially in a vertical direction (z-axis direction) and a horizontal recess section 5*b* extending essentially in a horizontal direction (y-axis direction), the deflector 1 being accommodated only in the vertical recess section 5*a*. The vertical recess section 5*a* is delimited by a wall which can be subdivided into three wall sections, namely a lateral wall section 15 running essentially parallel to the lateral edges of the base support 2 (in the y-axis direction), a front wall section 16 running essentially at right angles to the lateral edges of the base support 2 (in the x-axis direction), and a rear wall section 17 running essentially at right angles to the lateral edges of the base support 2 (in the x-axis direction).

The tension spring of the door-weight compensating device (not shown in the Figures) is accommodated in the horizontal recess section 5*b*, the tension spring implemented here e.g. as a coil spring is disposed with its longitudinal axis parallel to the direction in which the horizontal recess section 5*b* extends (y-axis direction).

The deflector 1 is provided with a hollow cylindrical bearing bush 7 which is used to support it on the base support 2. For this purpose there is formed on the base support 2 inside the vertical recess section 5*b* a cylindrical bearing pin 6 which projects from the lateral wall section 15 in a direction (x-axis direction) approximately at right angles to the lateral edge. To support it on the base support 2, the deflector 1 with the bearing bush 7 is pushed onto the bearing pin 6. Said bearing bush 7 and cylindrical bearing pin 6 are dimensioned such that the deflector 1 can be swiveled about the cylindrical bearing pin 6. The axis of the cylindrical bearing pin 6 specifies a pivot axis 8 for the deflector 1 mounted on the base support 2.

Figure 4:
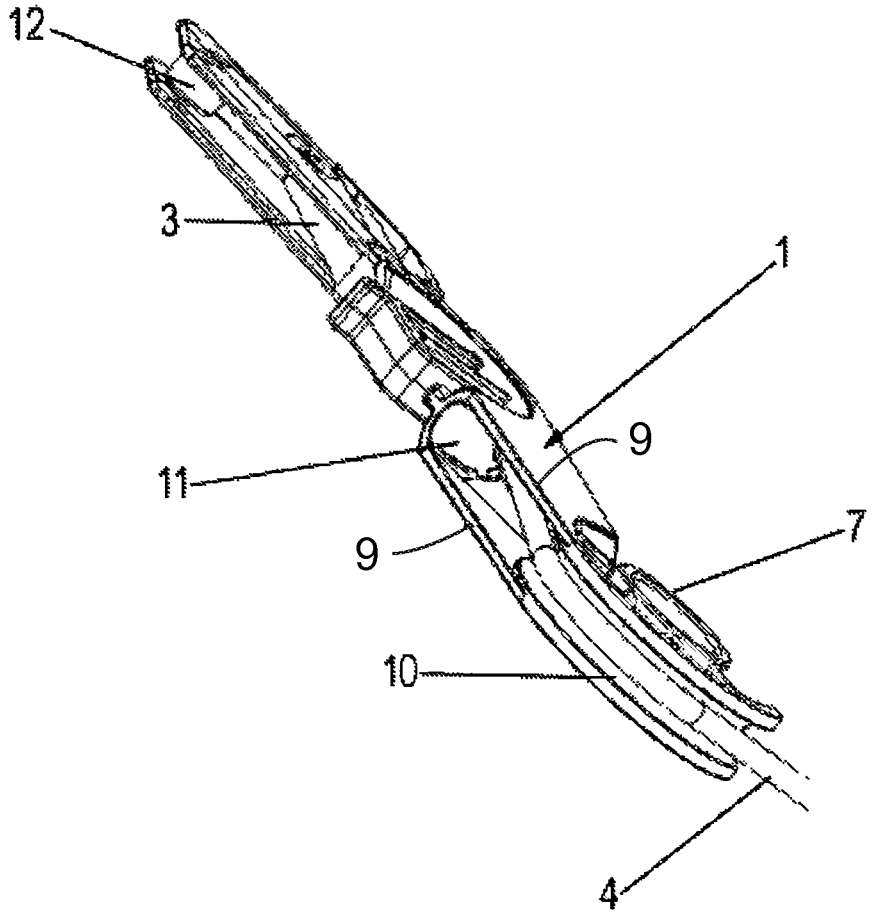
FIG. 4 shows in another schematic perspective view the deflector and the hook-in device for the tension transmitting means of the door-weight compensating device of FIG. 1.

As can be seen in particular from FIG. 4, the deflector 1 comprises two mutually separate sliding surfaces for the tension cable 4, namely a circular-segment-shaped first sliding surface 10 and a circular-segment-shaped second sliding surface 11 which are disposed in an approximately mirror-inverted manner relative to one another so that the threaded-in tension cable 4 is guided by the two sliding surfaces 10, 11 in an approximately "S"-shaped manner. The first sliding surface 10 is rigidly connected to the bearing bush 7 via reinforcing webs 20. The second sliding surface 11 is stiffened by reinforcing ribs 21. Disposed in the area between the circular-segment-shaped sliding surfaces 10, 11 are two sideplates 9 which interconnect the two sliding surfaces and retain the tension cable 4 in the sliding guide. The two sliding surfaces 10, 11 are made of plastic, for example, the two sideplates 9 and the other components of the deflector 1 of a metallic material, for example. The sliding properties of the tension cable 4 and therefore the door opening characteristic can therefore be influenced in a targeted manner via the coefficients of sliding friction of the material selected for the two sliding surfaces.

FIGS. 1 and 4 show a hook-in device 3 which is used to connect the tension cable 4 to the hinge lever. In the assembled state, the hook-in device 3 is outside the recess 5 and above the deflector 1. The hook-in device 3 is not attached to the deflector 1 but is only connected to the deflector via the outgoing tension cable 4 from the second sliding surface 11 of the deflector 1, which is not shown in greater detail in the Figures. The tension cable 4 is attached to the hook-in device 3. For connection to the hinge lever, the hook-in device 3 is provided with a hook-in web 12 which can be gripped by the hinge lever by means of a hook-shaped extension, thereby connecting the tension cable 4 to the hinge lever or rather the front door (as shown, for example, in the applicant's published unexamined German patent application DE 196 11 051 A1).

Spaced apart from the lateral wall section 15 delimiting the vertical recess section 5*a* and extending parallel to the lateral wall section 15, a plurality of locking ribs 13 project from the front wall section 16 into the vertical recess section 5*a*. The locking ribs 13 therefore extend approximately at right angles to the pivot axis 8 of the deflector 1. Between the locking ribs 13 and the lateral wall section 15 there remains a space 14 which is dimensioned such that it can accommodate the deflector 1 pushed onto the bearing pin 6 when it is swiveled about the bearing pin 6. The locking ribs 13 together with the lateral wall section 15 and the front wall section thus form a receptacle for the deflector 1. If the deflector 1 is in the space 14 between the back wall 15 and the locking ribs 13, it is locked by the locking ribs 13 against axial displacement along the pivot axis 8.

To deflect the pulling direction of the tension cable 4, the door-weight compensating device has a deflector 1 pivotally mounted to the bearing pin 6 on the base support 2 and locked against axial displacement by the locking ribs 13. The tension cable 4 is attached on the one hand to a tension spring mounted on the base support 2 and, on the other, to the hook-in device 3. A hinge lever pivotally mounted to the hinge plate engages in the hook-in device 3 with one lever arm, its other lever arm being attached to the front door. The front door is held in its closed position via a preloaded tension spring, said tension spring being (more heavily) loaded when the front door is opened and (partially) unloaded when the front door is closed, so that the weight force of the front door or more precisely the torque produced by the weight force is counteracted by the spring force during opening and closing of the front door.

The deflector 1 pivotally mounted on the bearing pin 6 can be adjusted in its rotational position about the pivot axis 8 against the spring force of the tension spring by means of an adjusting screw not shown in greater detail which is located inside an adjustment screw sleeve 18 and rests against a front contact surface 19 of the deflector 1, in order to adjust the preloading of the tension spring. Said preloading of the tension spring can in particular be adapted to a changed front door weight, e.g. by mounting linings to the front door.

The door-weight compensating device can be assembled by first threading the tension cable 4 mounted on the tension spring through the deflector 1 and attaching it to the hook-in device 3. In the horizontal recess section 5*b*, the tension spring is attached to the base support 2 from the side and, in the vertical recess section 5*a*, the deflector 1 is pushed up onto the cylindrical bearing pin 6, likewise from the side. When the hinge lever is engaged in the hook-in device 3 and the tension spring is preloaded by means of the adjustment screw, the deflector 1 is pulled by the preloading spring force of the tension spring into the space between the locking ribs 13 and the lateral wall section 15 where it is secured by the spring force. Assembly of the door-weight compensating device can therefore be performed quickly and reliably, without having to change the position of the base support 2 for this purpose.

The deflector 1 is implemented as a mirror-symmetrical identical part. Because of the axial locking of the swivel bearing by means of the locking ribs 13, it is possible to install the deflector 1 in unchanged form both on the left lateral edge and on the right lateral edge of the base support 2.

LIST OF REFERENCE CHARACTERS

1 Deflector
2 Base support
3 Hook-in device
4 Tension transmitting means
5 Recess
5*a* Vertical recess section
5*b* Horizontal recess section
6 Bearing pin
7 Bearing bush
8 Pivot axis
9 Sideplates
10 First sliding surface
11 Second sliding surface
12 Hook-in web
13 Locking element
14 Interspace
15 Lateral wall section
16 Front wall section
17 Back wall section
18 Adjustment screw sleeve
19 Contact surface
20 Reinforcing webs
21 Reinforcing ribs

The invention claimed is:

1. An appliance, comprising:

a treatment container including a container door pivotable about a pivot axis; and a door-weight compensating device for at least partially compensating a weight of the container door, the door-weight compensating device including a spring which is connected by a tension transmitter in a spring force transmitting manner to the container door, wherein the container door includes a pivotable deflector, the deflector having at least two mutally separate sliding surfaces for deflecting the tension transmitter, wherein the deflector further comprises two side plates arranged on the deflector in a region between the two sliding surfaces, which connect the two sliding surfaces together and retain the tension transmitter between the two side plates.

2. The appliance as claimed in claim 1, wherein the deflector is structured to engage with a locking element to secure the deflector against axial movement.

3. The appliance as claimed in claim 2, wherein the deflector is held by door weight forces in a position of engagement with the locking element.

4. The appliance as claimed in claim 2, wherein the locking element is disposed on a base support to which the treatment container of the appliance is attached,wherein the deflector is mounted in an axial direction on a bearing pin of the base support, and then subsequently pivotable such a portion of the deflector is aligned with a portion of the locking element to prevent axial movement relative to the bearing pin.

5. The appliance as claimed in claim 1, wherein the sliding surfaces are structured as circular segment sections.

6. The appliance as claimed in claim 5, wherein the sliding surfaces are disposed minor-symmetrically to one another.

7. The appliance as claimed in claim 1, wherein a material of the sliding surfaces is different from a material from which other components of the deflector are made.

8. The appliance as claimed in claim 1, wherein the tension transmitter is one of a tension cable and tension belt.

9. The appliance as claimed in claim 1, wherein the spring is a coil spring.

10. An appliance as claimed in claim 1, wherein one of the two sliding surfaces is connected to a bearing bush via a plurality of reinforcing webs.

11. An appliance as claimed in claim 1, wherein one sliding surface of the two sliding surfaces includes reinforcing ribs to stiffen the one sliding surface.

12. An appliance as claimed in claim 1, wherein the side plates are made of a material different than a material of the two sliding surfaces.

13. A domestic appliance comprising:

a treatment tank with a container door pivotable about a pivot axis and a door weight compensating device to at least partially counterbalance the weight of the container door by a spring force of a spring, which is connected to a traction transfer element to transfer the spring force to the container door, the compensating device further including a deflection apparatus arranged to be pivotable about a pivot axis, wherein the deflection apparatus has at least two sliding surfaces to deflect the traction transfer element and two side plates are arranged on the deflection apparatus in a region between the two sliding surfaces, which connect the two sliding surfaces together and retain the traction transfer element between the two side plates.

14. A domestic appliance as claimed in claim 13, wherein the deflection apparatus is provided with a hollow cylindrical bearing bush and is mounted on a base support via said bearing bush.

15. A domestic appliance as claimed in claim 13, wherein each lateral side of the domestic appliance includes one said deflection apparatus.

16. A domestic appliance as claimed in claim 14, wherein each lateral side of the domestic appliance includes one said deflection apparatus.

* * * * *